US009287073B2

(12) United States Patent
Jang

(10) Patent No.: US 9,287,073 B2
(45) Date of Patent: Mar. 15, 2016

(54) CIRCUIT BREAKER

(71) Applicant: LSIS CO., LTD., Anyang-si, Gyeonggi-do (KR)

(72) Inventor: Bong Yun Jang, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 286 days.

(21) Appl. No.: 13/945,790

(22) Filed: Jul. 18, 2013

(65) Prior Publication Data

US 2014/0021170 A1 Jan. 23, 2014

(30) Foreign Application Priority Data

Jul. 23, 2012 (KR) ..... 10-2012-0079902

(51) Int. Cl.

| | |
|---|---|
| ***H01H 33/53*** | (2006.01) |
| ***H01H 9/34*** | (2006.01) |
| *H01H 71/02* | (2006.01) |
| *H01H 73/18* | (2006.01) |

(52) U.S. Cl.

CPC ..... *H01H 33/53* (2013.01); *H01H 9/342* (2013.01); *H01H 71/02* (2013.01); *H01H 73/18* (2013.01)

(58) Field of Classification Search

CPC ..... H01H 9/34; H01H 9/342; H01H 33/53; H01H 33/08

USPC ..... 218/34, 35, 149, 152–157

See application file for complete search history.

(56) References Cited

U.S. PATENT DOCUMENTS

| | | | | |
|---|---|---|---|---|
| 6,037,555 | A * | 3/2000 | Castonguay et al. | 218/157 |
| 6,188,036 | B1 | 2/2001 | Arnold | |
| 6,750,743 | B1 * | 6/2004 | Subramanian et al. | 218/157 |
| 8,063,334 | B2 * | 11/2011 | Dahl | 218/114 |
| 2005/0219021 | A1 | 10/2005 | Fleege et al. | |
| 2009/0194510 | A1 | 8/2009 | Dahl | |

FOREIGN PATENT DOCUMENTS

| | | |
|---|---|---|
| CN | 1622250 | 6/2005 |
| JP | 2008-226632 | 9/2008 |
| JP | 2009-295293 | 12/2009 |
| KR | 10-2009-0055101 | 6/2009 |

OTHER PUBLICATIONS

Korean Intellectual Property Office Application Serial No. 10-2012-0079902, Notice of Allowance dated Jun. 28, 2013, 6 pages.

European Patent Office Application Serial No. 13176966.3, Search Report dated Nov. 20, 2013, 5 pages.

The State Intellectual Property Office of the People's Republic of China Application Serial No. 201310311895.6, Office Action dated Feb. 27, 2015, 7 pages.

* cited by examiner

*Primary Examiner* — Amy Cohen Johnson

*Assistant Examiner* — Marina Fishman

(74) *Attorney, Agent, or Firm* — Lee, Hong, Degerman, Kang & Waimey

(57) ABSTRACT

Disclosed is a circuit breaker. The circuit breaker includes an arc exhaust port for exhausting an arc generated in the inner box; an outer box receiving the inner box and including an arc passage for exhausting the arc from the exhaust port to an outside; and an arc guide part for guiding the arc from the arc exhaust port into the arc passage, wherein the arc guide part includes: an upper guide; a lower guide spaced apart from the upper guide; and a connecting part connecting the upper and lower guides to each other in a longitudinal direction.

11 Claims, 14 Drawing Sheets

CIRCUIT BREAKER

CROSS-REFERENCE TO RELATED APPLICATIONS

Pursuant to 35 U.S.C. §119(a), this application claims the benefit of earlier filing date and right of priority to Korean Patent Application No. 10-2012-0079902, filed on Jul. 23, 2012, the contents of which is incorporated by reference herein in its entirety.

BACKGROUND

The disclosure relates to a circuit breaker.

In general, a circuit breaker is a device for maintaining safety by blocking a circuit in an abnormal state such as an overload or a short circuit. That is, when a current exceeding a rated current flows through an electric circuit, the circuit breaker performs a function of blocking the current flow in order to protect a worker.

Hereinafter, a circuit breaker will be described with reference to accompanying drawings.

FIG. 1 is a perspective view showing a circuit breaker according to the related art.

Referring to FIG. 1, the circuit breaker 1 includes an upper outer box (refer to reference numeral 20 in FIG. 2) which defines an upper appearance, a lower outer box 10 which defines a lower appearance, and an inner box 30 disposed in the upper and lower outer boxes 20 and 10. When a user operates a switch lever to control an operation of the circuit breaker 1, fixed and movable contactors placed in the circuit breaker 1 are separated from each other, so that a high-temperature thermal arc is generated between both contactors. The arc damages an electric conductor and a forming component in the circuit breaker 1. Therefore, there is a need to rapidly exhaust the arc generated in the circuit breaker 1 to an outside.

FIG. 2 is a view showing an exhaust port structure of a load part of a circuit breaker according to the related art.

Referring to FIG. 2, the exhaust port structure of the load part of the circuit breaker includes an inner box 30, a load part arc exhaust port 12 connected to the inner box 30, an arc guide part 14 for guiding a movement of an arc passing through the load part arc exhaust port 12, and an arc passage forming part 13 for providing an passage through which an arc guided by the arc guide part 14 is exhausted. The acr guide part 14 is inclined upward about a horizontal direction such that the arc guide part 14 may be connected to a load part arc passage 15.

The arc passage forming part 13 includes the load part arc passage 15 for providing an exit and entry passage of an arc and a protrusion part 11 adjacent to the load part arc passage 15. The protrusion part 11 may include a plurality of inclined parts 11*a* and for example, may have a shape of a trigonal prism.

A moving path of the arc generated from the load part of the circuit breaker 1 is as follows.

An arc initially generated from the inner box 30 of the circuit breaker 1 passes through the load part arc exhaust port 12 and the arc, which passes through the load part arc exhaust port 12, passes through the load part arc passage 15 along the arc guide part 14 to be exhausted to an outside of the circuit breaker 1.

However, since the load part arc exhaust port 12 is spaced apart from the load part arc passage 15 and a configuration of continuously guiding the arc exhausted from the load part arc exhaust port 12 into the load part arc passage 15 does not exist, the arc, which passes through the load part arc exhaust port 12, is not rapidly exhausted to an outside of the circuit breaker 1 so that voltage leakage and reverse current phenomenons occur in the circuit breaker 1.

FIG. 3 is a view showing an arc exhaust structure of a power source part of a circuit breaker according to the related art.

Referring to FIG. 3, the arc exhaust structure of the circuit breaker includes an inner box 30, a power source arc exhaust port 25 connected to the inner box 30, a power source arc passage forming part 22 for guiding a movement of an arc passing through the power source arc exhaust port 25.

The power source arc passage forming part 22 includes a passage guide part 22*a* having a round shape and a passage inclined part 22*b* connected to the passage guide part 22*a* and inclined at a predetermined angle. An arc may be exhausted into an outside of the circuit breaker 1 through a power source arc passage 21 which is an inner space in which the passage guide part 22*a* and the passage inclined part 22*b*.

A moving path of the arc generated from the power source part of the circuit breaker 1 is as follows An arc initially generated from the inner box 30 of the circuit breaker 1 passes through the power source arc exhaust port 25 and the arc, which passes through the power source arc exhaust port 25, passes through the power source arc passage 21 to be exhausted into an outside of the circuit breaker 1.

However, since the power source arc exhaust port 25 is spaced apart from the power source arc passage 21 and a configuration of continuously guiding the arc exhausted from the power source arc exhaust port 25 into the power source arc passage 21 does not exist, the arc, which passes through the power source arc exhaust port 25, is not rapidly exhausted to an outside of the circuit breaker 1, so that voltage leakage and reverse current phenomenons may occur in the circuit breaker 1.

SUMMARY

The embodiment provides a circuit breaker in which an arc generated by operating the circuit breaker is rapidly exhausted so that a residual or leakage arc is minimized in the circuit breaker.

According to one embodiment, there is provided a circuit breaker including an inner box including an arc exhaust port for exhausting an arc generated in the inner box; an outer box receiving the inner box and including an arc passage for exhausting the arc from the exhaust port to an outside; and an arc guide part for guiding the arc from the arc exhaust port into the arc passage, wherein the arc guide part includes: an upper guide; a lower guide spaced apart from the upper guide; and a connecting part connecting the upper and lower guides to each other in a longitudinal direction.

According to another embodiment, there is provided a circuit breaker including an inner box including an arc exhaust port for exhausting an arc generated in the inner box; an outer box receiving the inner box and including an arc passage for exhausting the arc from the arc exhaust port to an outside; and an arc guide part having one side making contact with the arc exhaust port for guiding the arc from the arc exhaust port into the arc passage, wherein the arc guide part protrudes at a predetermined length from a portion making contact with the arc exhaust port to the arc passage.

The details of one or more embodiments are set forth in the accompanying drawings and the description below. Other features will be apparent from the description and drawings, and from the claims.

DETAILED DESCRIPTION OF THE EMBODIMENTS

Figure 1:
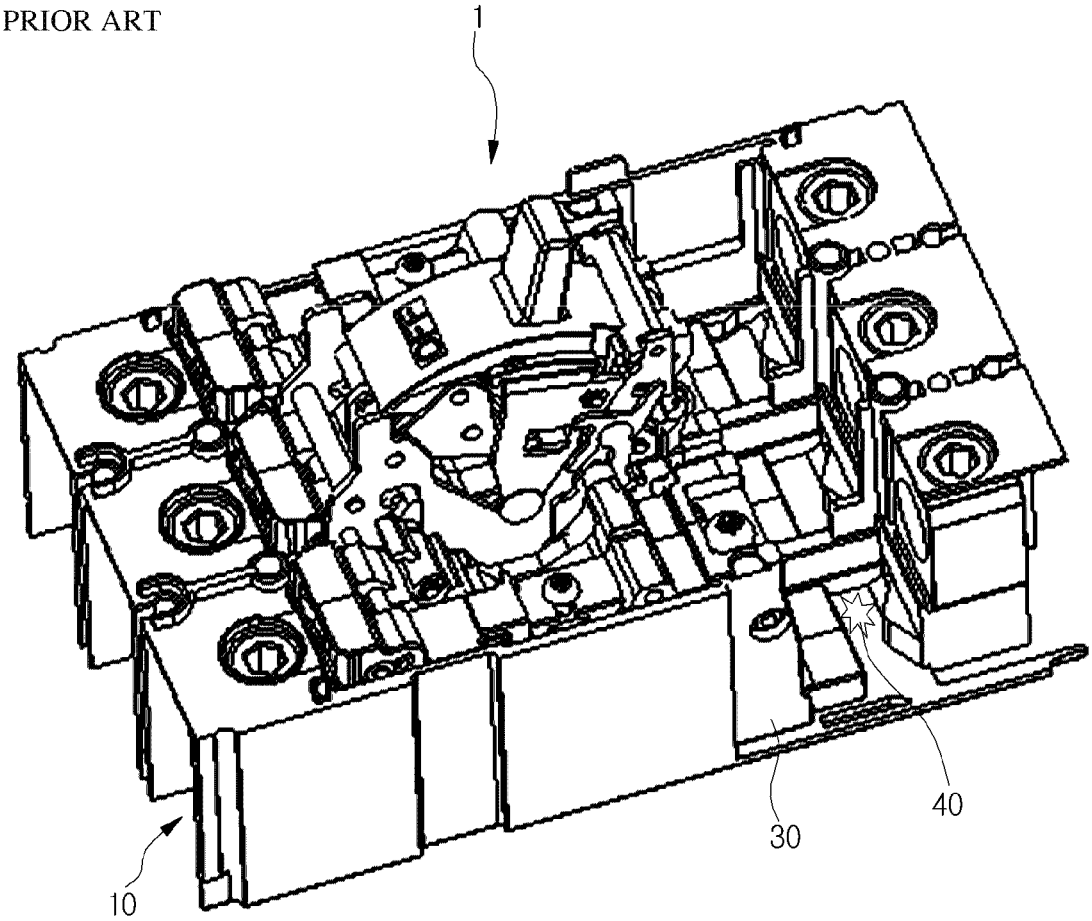
Fig. 1 PRIOR ART
FIG. 1 is a view showing a touch window according to the related art.
Figure 2:
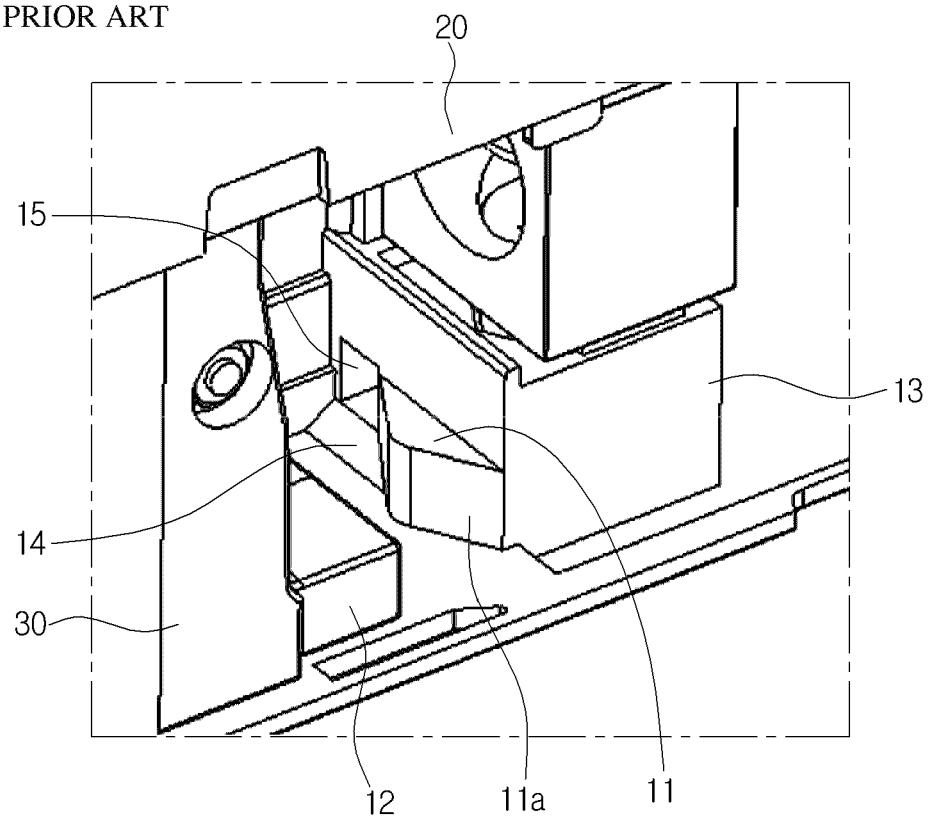
Fig. 2 PRIOR ART
FIG. 2 is a view showing an exhaust port structure of a load part of a circuit breaker according to the related art.
Figure 3:
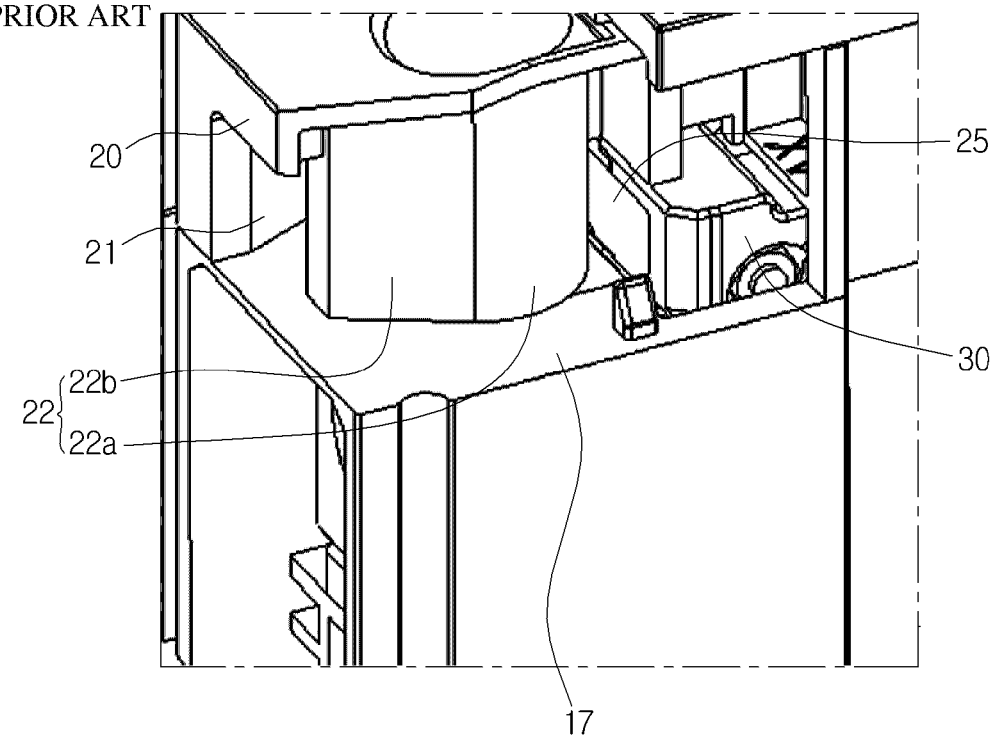
Fig. 3 PRIOR ART
FIG. 3 is a view showing an arc exhaust structure of a power source part of a circuit breaker according to the related art.

Hereinafter, the structure and the operation according to the embodiment will be described in detail with reference to accompanying drawings. In the following description based on the accompanying drawings, the same elements will be assigned with the same reference numerals regardless of drawing numbers, and the repetition in the description of the same elements having the same reference numerals will be omitted in order to avoid redundancy. Although the terms "first" and "second" may be used in the description of various elements, the embodiment is not limited thereto. The terms "first" and "second" are used to distinguish one element from the other elements.

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 4:
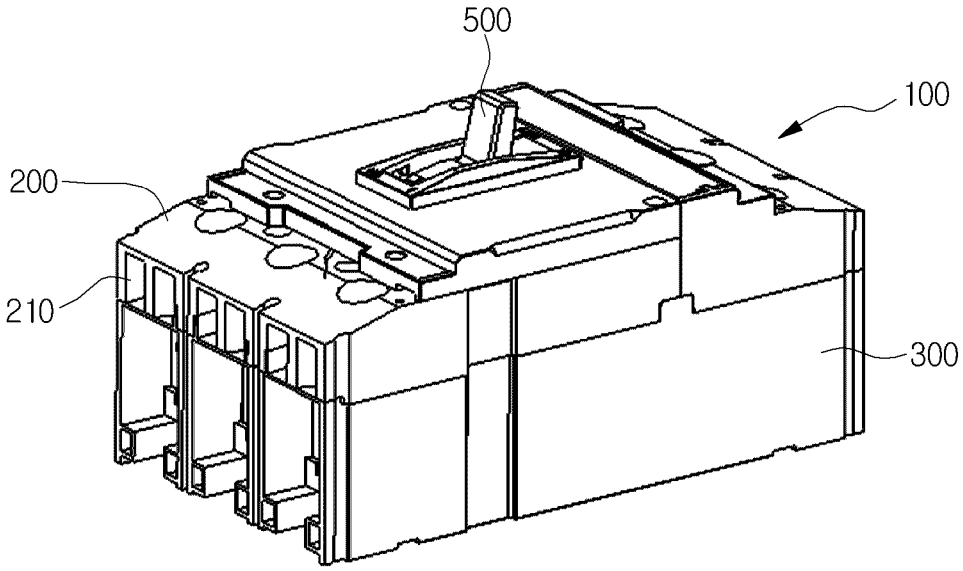
FIG. 4 is a perspective view showing a circuit breaker according to the embodiment.

FIG. 4 is a perspective view showing a circuit breaker according to the embodiment.

Referring to FIG. 4, the circuit breaker 100 according to the embodiment includes an upper outer box 200 of defining an upper appearance and a lower outer box 300 of defining a lower appearance. A user may operate a switch lever 500 for controlling a power source of the circuit breaker 100.

For example, if the user operates the switch lever 500 to turn off the power source of the circuit breaker 100, fixed and movable contactors are separated from each other, so that a high-temperature thermal arc is generated between both contactors. In this case, since an electric conductor and a forming component in the circuit breaker 100 may be damaged by the arc, there is a need to rapidly exhaust the arc in the circuit breaker 100 to an outside.

Therefore, when an arc is generated, the arc is exhausted to an outside through a power source arc passage 210 in a power source part of the circuit breaker and the arc is exhausted to an outside through a load part arc passage (refer to reference number 310 in FIG. 5) in a load part of the circuit breaker.

Hereinafter, a first arc exhaust structure provided in the load part of the circuit breaker and a second arc exhaust structure provided in a power source part of the circuit breaker will be described in detail.

First, the first arc exhaust structure will be described.

Figure 5:
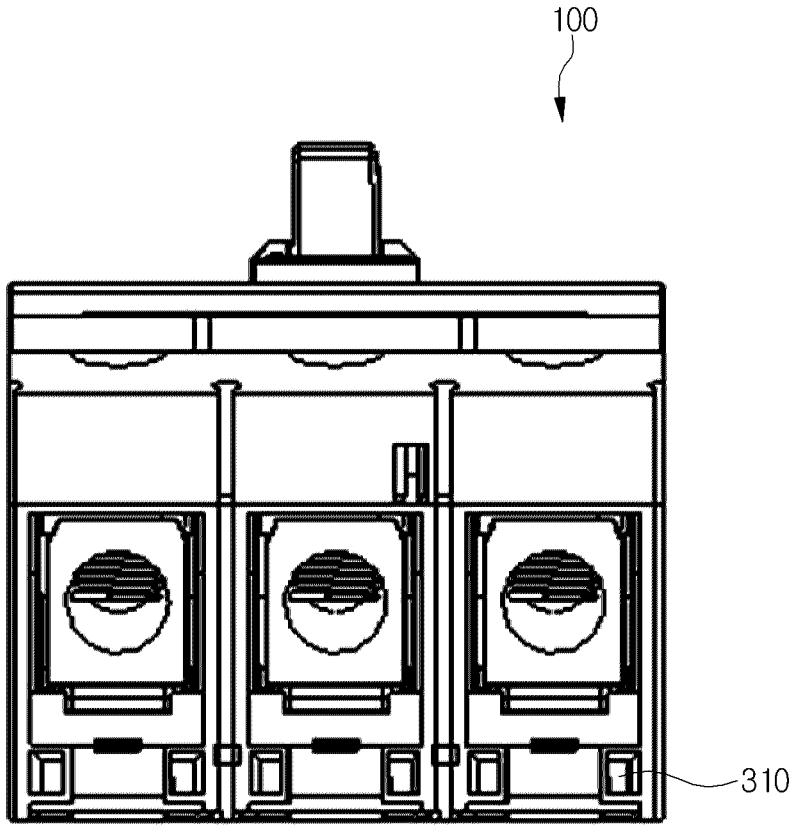
FIG. 5 is a view of the circuit breaker when viewed at the load part of the circuit breaker.
Figure 6:
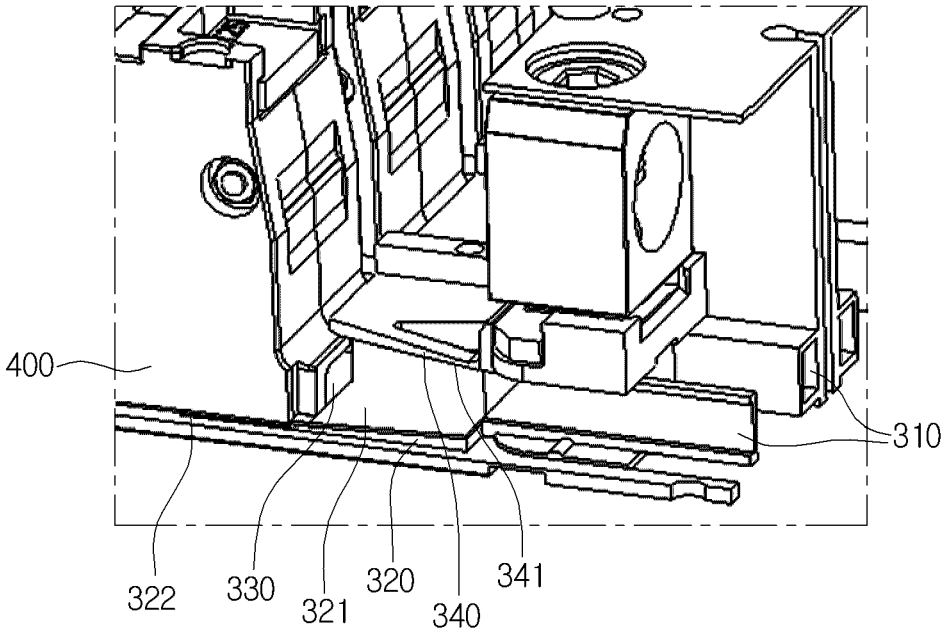
FIG. 6 is a view showing the first arc exhaust structure according to an embodiment.
Figure 7:
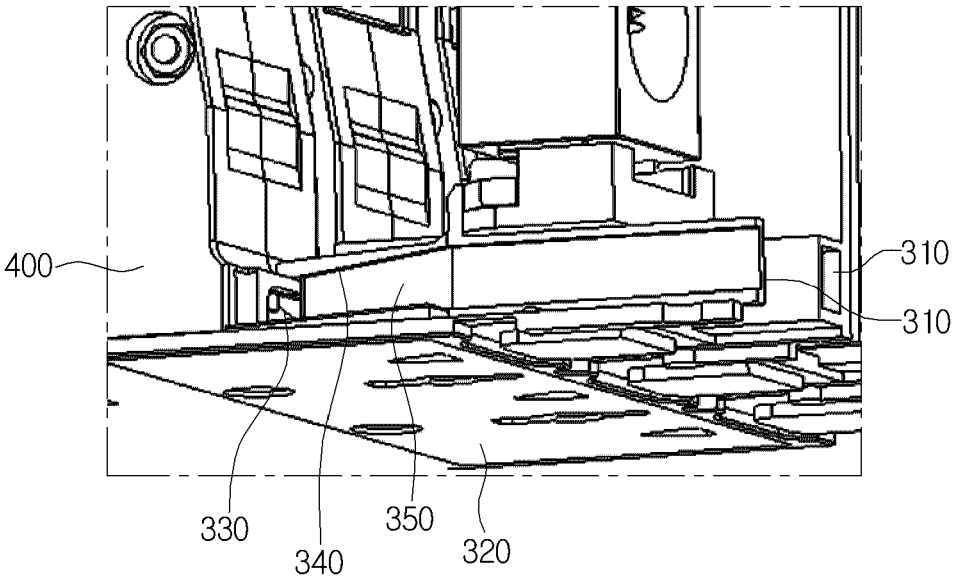
FIG. 7 is a perspective view showing the first arc exhaust structure according to an embodiment.
Figure 8:
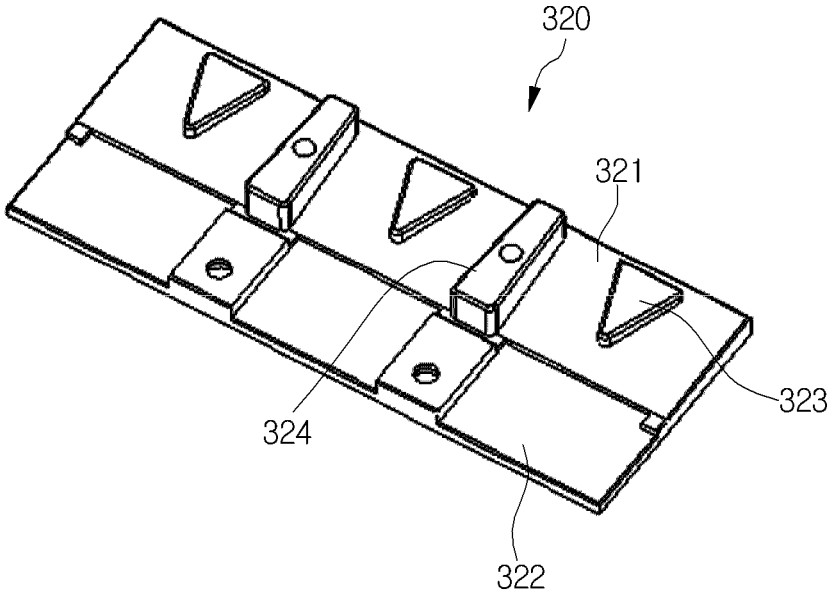
FIG. 8 is a perspective view showing a lower guide according to an embodiment.

FIG. 5 is a view of the circuit breaker when viewed at the load part of the circuit breaker. FIG. 6 is a view showing the first arc exhaust structure according to an embodiment. FIG. 7 is a perspective view showing the first arc exhaust structure according to an embodiment. FIG. 8 is a perspective view showing a lower guide according to an embodiment.

First, referring to FIGS. 5 and 6, the first arc exhaust structure includes an inner box 400, a load part arc exhaust port 330 connected to the inner box 400, a load part arc passage 310 for exhausting the arc exhausted from the load part arc exhaust port 330 to an outside of the circuit breaker 100, and lower and upper guides 320 and 340 for guiding the arc exhausted from the load part arc exhaust porting 330 to the load part arc passage 310.

The lower guide 320 includes a lower inclined surface 321 and the upper guide 340 includes an upper inclined surface 341. A distance between the upper and lower inclined surfaces 341 and 321 may be gradually narrowed from the load part arc exhaust port 330 to the load part arc passage 310.

For example, the lower inclined surface 321 may be gradually inclined upward from the load part arc exhaust port 330 to the load part arc passage 310.

The upper inclined surface 341 may be gradually inclined downward from the load part arc exhaust port 330 to the load part arc passage 310.

In some cases, an inclined surface may be formed on either the upper guide 340 or the lower guide 320.

The upper inclined surface 341 and the lower inclined surface 321 may be connected to each other through a connecting part (refer to reference number 350 in FIG. 7: which may be called a side surface guide) extending in a longitudinal directions. Further, one side of the connecting part (refer to reference number 350 in FIG. 7) is connected to the load part arc passage 310.

Thus, the arc passing through the load part arc exhaust port 330 may be continuously guided by the upper inclined surface 341, the lower inclined surface 321 and the connecting part (refer to reference number 350 in FIG. 7), so that the arc may flows into the load part arc passage 310.

The arc traveling between the upper and lower inclined surfaces 341 and 321 is exhausted to an outside of the circuit breaker 100 through the load part arc passage 310.

Hereinafter, the lower guide 320 will be described in detail with reference to the accompanying drawings.

Referring to FIGS. 7 and 8, the lower guide 320 includes an extension surface 322 placed at a lower side of the inner box 400 and formed in a horizontal direction, and the lower inclined surface 321 connected to the extension surface 322 and inclined upward at a predetermined angle. The lower inclined surface 321 may include a plurality of guide protrusions 323, each of which has, for example, a triangular shape. Further, the lower inclined surface 321 may include a plurality of partition parts 324 for partitioning the passage of the arc exhausted from each load part arc exhaust port 330.

The plurality of protrusions 323 and a plurality of supporting parts 324 may be disposed alternately with each other. The shape and position of the protrusions 323 are not limited to the above. Hereinafter, a path, along which an arc travels in the load part of the circuit breaker, will be described.

If an arc is generated while the fixed and movable contactors are being separated from each other, the arc moves into the inner box 400 which constitutes an interior of the circuit breaker 100. The arc, which passes through the inner box 400, passes through the load part arc exhaust port 330 which has a narrow passage, and then, travels along the space between the upper and lower inclined surfaces (refer to reference numerals 341 and 321 in FIG. 6) which are connected to the upper and lower sides of the load part arc exhaust port 300, respectively. Then, the arc travels along the load part arc passage 310.

According to a first arc exhaust structure of the embodiment, since the arc, which passes through the load part arc exhaust port 330, may move into the load part arc passage 310 by the upper and lower guides (refer to reference numerals 340 and 320 in FIG. 6), it is possible to exhaust the arc to an outside of the circuit breaker 100.

In addition, since the distance between the upper and lower inclined surfaces (refer to reference numerals 341 and 321 in FIG. 6) is gradually narrowed in the moving direction of the arc, the moving speed of the arc is increased so that the arc can be rapidly exhausted to an outside of the circuit breaker 100.

Figure 9:
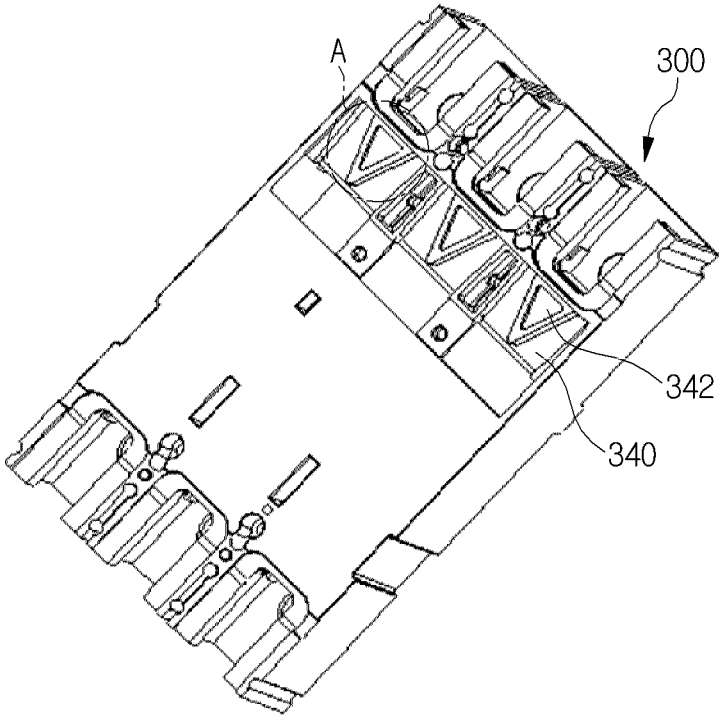
FIG. 9 is a perspective view showing a bottom surface of a lower outer box before the lower outer box is assembled with a lower guide according to an embodiment.
Figure 10:
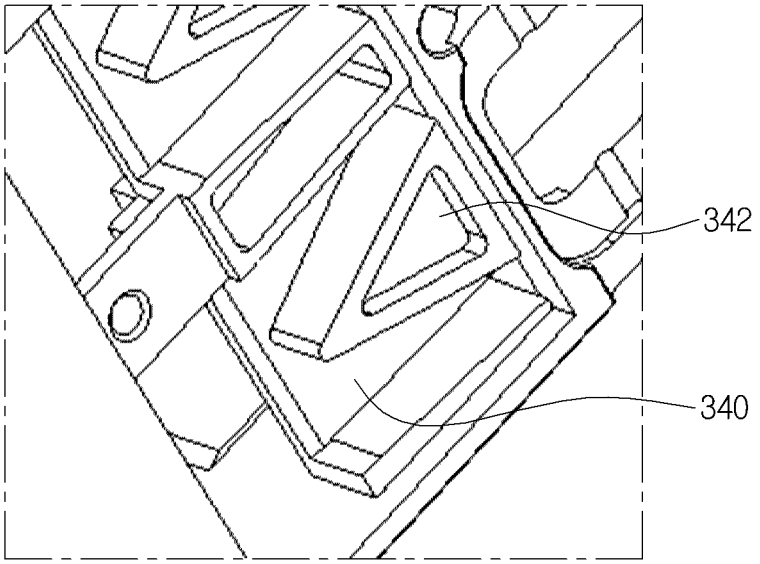
FIG. 10 is an enlarged view of portion A in FIG. 9.
Figure 11:
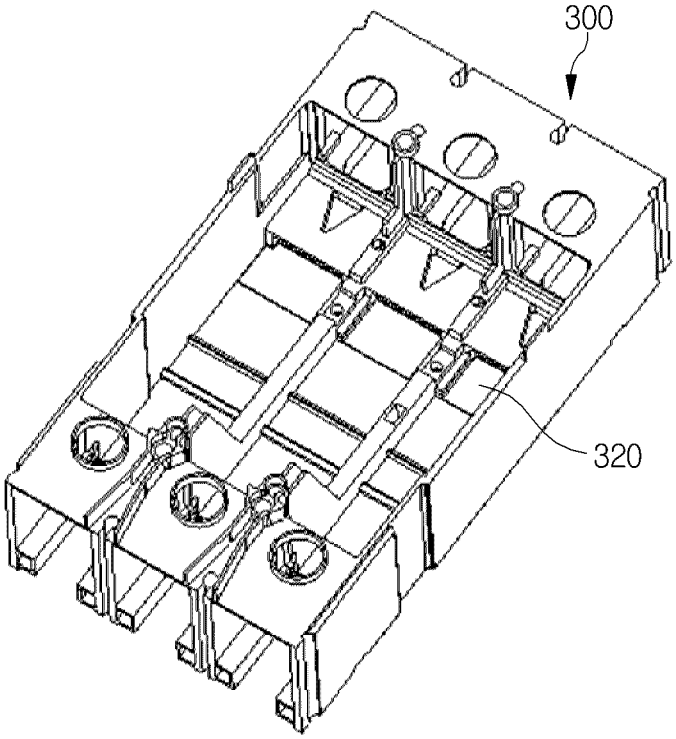
FIG. 11 is a perspective view showing a lower outer box after the lower outer box is assembled with a lower guide according to an embodiment.
Figure 12:
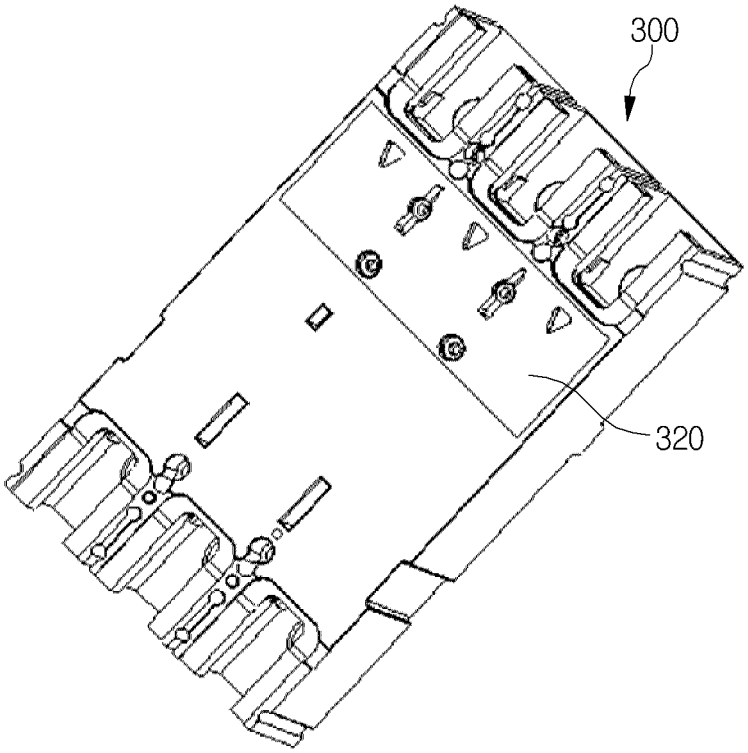
FIG. 12 is a perspective view showing a lower surface of a lower outer box after the lower outer box is assembled with a lower guide according to an embodiment.

FIG. 9 is a perspective view showing a bottom surface of a lower outer box before the lower outer box is assembled with a lower guide according to an embodiment. FIG. 10 is an enlarged view of portion A in FIG. 9. FIG. 11 is a perspective view showing a lower outer box after the lower outer box is assembled with a lower guide according to an embodiment. FIG. 12 is a perspective view showing a lower surface of a lower outer box after the lower outer box is assembled with a lower guide according to an embodiment.

Referring to FIGS. 9 to 12, the lower outer box 300 includes the upper guide 340 for guiding an arc into the load part arc passage 310. The upper guide 340 may be formed integrally with the lower outer box 300. Also, the upper guide 340 may be coupled to the lower outer box 300.

The upper guide 340 includes a guide groove 342 corresponding to a guide protrusion 323 formed in the lower guide 320. The guide protrusion 323 may be inserted into the guide groove 342. For example, the guide protrusion 323 may have a triangular shape, and the guide groove 342 may be formed in a triangular shape corresponding to that of the guide protrusion 323.

The lower guide 320 is coupled to the upper guide 340. In detail, the guide protrusion 332 of the lower guide 320 may be coupled to the guide groove 342 of the upper guide 340. For another example, by forming a plurality of couplers at mutually correspond positions in sides of the upper and lower guides 340 and 320, the upper and lower guides 340 and 320 may be coupled to each other.

A space is formed by coupling the upper and lower guides 340 and 320 to each other, such that the arc generated from the load part arc exhaust port (refer to reference numeral 330 in FIG. 7) may travel into the load part arc passage (refer to reference numeral 310 in FIG. 7) through the space.

In detail, when the guide protrusion 323 of the lower guide 320 is coupled into the guide groove 342 of the upper guide 340, the space, through which an arc travels, is formed between the upper and lower guides 340 and 320.

The arc generated from the load part arc exhaust port (refer to reference numeral 330 in FIG. 7) may travel into the load part arc passage (refer to reference numeral 310 in FIG. 7) along the arc travelable space formed between the upper and lower guides 340 and 320, so that the arc may be exhausted to an outside.

Although it has been described in the embodiment that the guide groove is formed in the upper guide and the guide protrusion is formed in the lower guide, to the contrary, it is possible that the guide protrusion is formed in the upper guide and the guide groove is formed in the lower guide.

Hereinafter, the second arc exhaust structure and a moving flow of an arc will be described.

Figure 13:
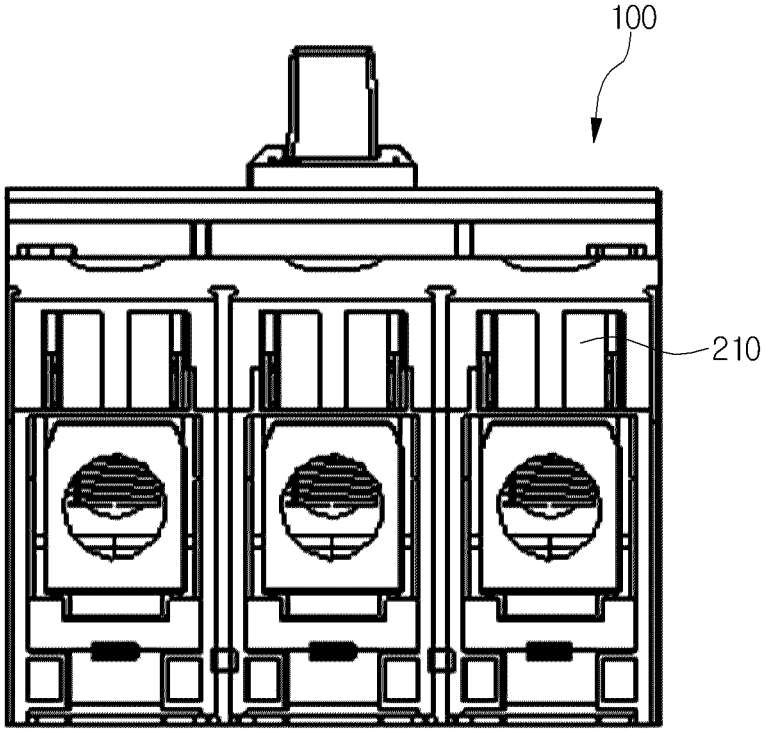
FIG. 13 is a view showing a circuit breaker when viewed from a power source part.
Figure 14:
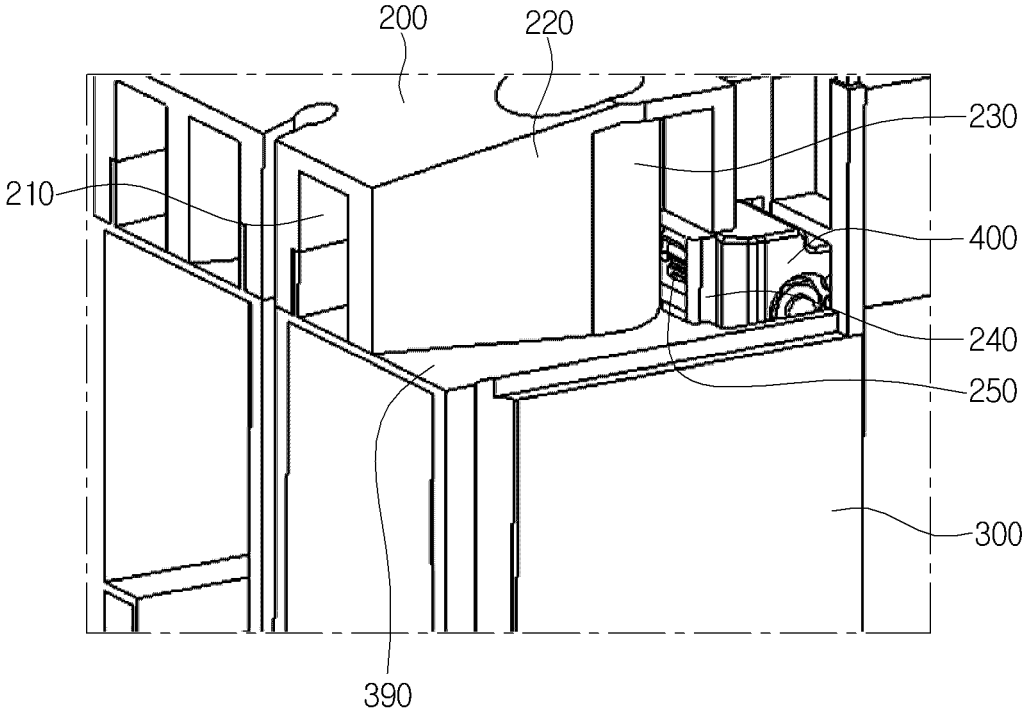
FIG. 14 is a view showing a second arc exhaust structure according to an embodiment.

FIG. 13 is a view showing a circuit breaker when viewed from a power source part. FIG. 14 is a view showing a second arc exhaust structure according to an embodiment.

Referring to FIGS. 13 and 14, the second arc exhaust structure includes an inner box 400, a power source arc guide part 240 connected to the inner box 400, a power source arc exhaust port 250 through which the arc guided by the power source arc guide part 240 is exhausted, and a passage guide part 230 and a passage inclined part 220 which form a power source arc passage.

The power source arc guide part 240 may protrude from the inner box 400 by a predetermined length. A cross sectional area of a passage of the power source arc exhaust port 250 may be gradually decreased as the power source arc guide part 240 is closed to the passage guide part 230 in the inner box 400. Further, the passage guide part 230 may have a round shape.

The power source arc guide part 240 may make contact with the passage guide part 230. For another example, the power source arc exhaust port 250 may make contact with the power source arc guide part 240.

The arc, which passes through the power source arc exhaust port 250, travels along the passage guide part 230. The arc, which passes through the passage guide part 230, travels along the passage inclined part 220 which has a top surface inclined downward at a predetermined angle. Then, after the arc travels along the power source arc passage 210, the arc is exhausted to an outside of the circuit breaker 100.

Hereinafter, a moving path of an arc in the power source part of the circuit breaker will be described.

If an arc is generated while the fixed and movable contactors are being separated from each other, the arc moves in the inner box 400 which constitutes an interior of the circuit breaker 100. The arc passing through the inner box 400 passes through the power source arc exhaust port 250, which is a narrow passage, along the power source arc guide part 240. Then, after a moving direction of the arc is guided by the passage guide part 230 so that the arc travels along the passage inclined part 220, the arc is exhausted through the power source arc passage 210 to an outside of the circuit breaker 100.

According to the embodiment, since an arc may be guided into the passage guide part through the power source arc guide part 240, a leakage voltage occurring in the circuit breaker due to the arc can be prevented.

Further, since the cross sectional area of the passage is gradually decreased toward the passage guide part 230 so that the moving speed of the arc is increased, the arc can be rapidly exhausted to an outside of the circuit breaker 100.

Further, the top and side surfaces of the passage inclined part 220 are inclined at a predetermined angle, so that the cross sectional area of the passage is gradually decreased as going away from the passage guide part 230, thereby gradually increasing the moving speed of the arc. Thus, the arc can be rapidly exhausted to an outside of the circuit breaker 100.

In the disclosure, the upper guide, the lower guide and the connecting part may be generally called "load-side arc guide part".

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A circuit breaker comprising:

an inner box including an arc exhaust port for exhausting an arc generated in the inner box;

an outer box receiving the inner box and including an arc passage for exhausting the arc from the exhaust port to an exterior; and an arc guide part for guiding the arc from the arc exhaust port into the arc passage;

wherein the arc guide part comprises:

an upper guide;

a lower guide spaced apart from the upper guide;

a connecting part connecting the upper and lower guides to each other in a longitudinal direction;

a first guide protrusion and a second guide protrusion formed on the lower guide;

a guide groove formed on the upper guide; and at least one partition part formed on the lower guide, wherein a first partition part of the at least one partition part is disposed between the first and second guide protrusions and protrudes from the lower guide at a predetermined height such that the arc exhausted from the arc exhaust port is partitioned.

2. The circuit breaker of claim 1, wherein at least the upper guide or the lower guide comprises an inclined surface.

3. The circuit breaker of claim 2, wherein the lower guide comprises a lower inclined surface, and the lower inclined surface is gradually inclined upward from the arc exhaust port to the arc passage.

4. The circuit breaker of claim 3, wherein the upper guide comprises an upper inclined surface, and the upper inclined surface is gradually inclined downward from the arc exhaust port to the arc passage.

5. The circuit breaker of claim 4, wherein a distance between the upper and lower inclined surfaces is decreased at a predetermined ratio from the arc exhaust port to the arc passage.

6. The circuit breaker of claim 4, wherein the arc exhaust port is disposed at one side of the connecting part and the arc passage is disposed at an opposite side of the connecting part.

7. The circuit breaker of claim 6, wherein a width of the connecting part is reduced at a predetermined ratio from the arc exhaust port to the arc passage.

8. The circuit breaker of claim 1, wherein the at least one partition part comprises a second partition part adjacent to the first partition part; and wherein an arc moves through first and second passages located between the first partition part and the second partition part.

9. The circuit breaker of claim 8, wherein:

the first passage is defined as a space between a first side of the first guide protrusion and the first partition part, and the second passage is defined as a space between a second side of the first guide protrusion and the second partition part.

10. The circuit breaker of claim 1, wherein the arc passage is formed by a passage guide part, and the arc guide part extends from the arc exhaust port to make contact with the passage guide part.

11. The circuit breaker of claim 1, wherein a passage of the arc guide part is gradually decreased from the arc exhaust port to the arc passage.

* * * * *